US005660069A

United States Patent [19]

Williams

[11] Patent Number: 5,660,069

[45] Date of Patent: Aug. 26, 1997

[54] HANDS-FREE DUCT ASSEMBLY TOOL

[76] Inventor: Charles A. Williams, 24 RidgeTop Acres, Chandler, N.C. 28715

[21] Appl. No.: 523,440

[22] Filed: Sep. 5, 1995

[51] Int. Cl.[6] ..... B21D 17/00; B25B 7/02

[52] U.S. Cl. ..... 72/211; 81/424

[58] Field of Search ..... 72/211, 219, 220; 29/257, 262, 268; 81/318, 322, 323, 382, 387, 389, 395, 418, 420, 421, 422, 423, 424.5, 426, 426.5, 454, 185.1, 185.2, 186

[56] References Cited

U.S. PATENT DOCUMENTS

| | | | |
|---|---|---|---|
| 2,641,149 | 6/1953 | Peterson . | |
| 2,882,768 | 4/1959 | Nelson | 81/424 |
| 2,889,618 | 6/1959 | Morris et al. . | |
| 3,202,023 | 8/1965 | Parker | 81/423 |
| 3,304,818 | 2/1967 | Heaton . | |
| 3,771,482 | 11/1973 | Thompson . | |
| 4,398,334 | 8/1983 | Kovalevich | 29/243.5 |
| 4,472,867 | 9/1984 | Wivinis | 29/243.5 |
| 4,763,393 | 8/1988 | Gee | 29/238 |
| 4,872,709 | 10/1989 | Stack | 29/238 |
| 5,143,359 | 9/1992 | Bush | 81/424 |

*Primary Examiner*—Lowell A. Larson
*Assistant Examiner*—Rodney A. Butler
*Attorney, Agent, or Firm*—J. David Abernethy

[57] ABSTRACT

A duct assembly tool is provided with "vise grip" type handles to allow the tool to be completely released while it assembles sections of duct. Duct assembly flanges are closed together by gripping members which are rotatable with respect to the tool handles. The gripping members may be disc shaped to allow the tool to be used to straighten bowed duct walls.

5 Claims, 5 Drawing Sheets

HANDS-FREE DUCT ASSEMBLY TOOL

BACKGROUND OF THE INVENTION

This invention relates to a duct assembly tool for drawing and clamping two pieces of duct work together.

Duct work is typically used to convey heated and cooled air. The duct work may be hung from a building's rafters or subfloors. The ducts may be made from sheet metal, and they often have a rectangular shape. The ducts are often eight to twelve feet long. Rectangular ducts usually have on each end assembly flanges, sometimes called drive flanges, which are adapted to be assembled to a like flange on another duct to enable a cleat, sometimes called a drive, to be positioned over the flanges to secure the ducts to each other.

Tools have been used to draw together duct assembly flanges to enable the cleat to be driven onto the flanges. U.S. Pat. No. 3,304,818 describes a duct assembly tool having a pair of pivoted handles controlling a pair of rectangular duct gripping jaws which are about four inches long. The handles may be rotated relative to the duct gripping jaws about stub shafts provided at the points of intersection of the duct gripping jaws and the handles. To assemble ducts, pressure must be maintained on the handles by one hand while the other hand is used to apply the cleat over the assembly flanges.

Another duct assembly tool is described in U.S. Pat. No. 4,398,334. This tool includes two pairs of rollers mounted to the same side of a base plate. The tool is pushed forward so as to move the assembled flanges between the pairs of rollers. As the tool is moved, a cleat held in the tool is placed over the assembly flanges as the rollers pass over the assembly flanges. However, one side of the pair of ducts must be manually forced together to enable the tool to be used. In some installations, it is difficult or impossible to hold ducts together while devoting one hand to directing the assembly tool.

Yet another duct assembly tool is described in U.S. Pat. No. 4,763,393. This tool provides a pair of wheels which are moved together upon hand rotation of the tool to grip and hold two ducts to each other. However, the degree of mechanical advantage supplied by the tool is limited, and the requisite space must be available in a particular direction transverse to the ducts to allow for the rotation of the handle.

A problem not addressed by the foregoing tools is the habit of some construction laborers to apply excessive force on sections of duct, such as by walking on the duct, thereby deforming the sheet metal sections to be assembled. While the assembly flanges are crumpled, a cleat or drive cannot be placed over the flanges. It is believed that none of the foregoing tools would be effective to both draw together crumpled flanges and to apply outwardly directed force to the assembled crumpled flange to straighten them.

SUMMARY OF THE INVENTION

It is therefore an object of the present invention to provide a duct assembly tool supplying a greater degree of mechanical advantage to the task of drawing together spaced-apart duct sections than supplied by the prior art.

Another object of the invention is to provide such mechanical advantage while allowing the greatest possible degree of rotational freedom for use of the tool handles, namely a full 180 degrees from the plane of the duct surfaces to be assembled.

Yet another object of the invention is to provide clamping jaws usable upon assembly flanges which are in a somewhat crumpled state.

Still another object of the invention is to provide a duct assembly tool which is capable of being locked in a closed position, freeing both hands of the assembler for holding and hammering the cleat.

These and other objects are provided, according to the present invention, by providing a duct assembly tool having "Vise-grip" type handles, among other features. The duct assembly tool comprises first and second substantially C-shaped jaws disposed in a common plane with their open sides opposed, each jaw having a back bar and forward and rear legs extending from the ends of the back bar; a handle having a proximal end rigidly fixed to the rear leg of the first jaw; a first pivot coupling between the distal end of the rear leg of the second jaw and the proximal end of said handle; a handle lever; a second pivot coupling between a proximal end of said handle lever and the rear leg of the second jaw at a location which is a substantial distance along the rear leg of the second jaw from the first pivot coupling; a rigid disc-shaped gripping member mounted to a distal end of each of said forward legs at a distance from the forward leg to which it is mounted sufficient to enable a duct cleat to be inserted between said gripping member and the forward leg to which it is mounted; and, a toggle link coupling between the handle and the handle lever for locking the jaws against separation when the handle and the handle lever are forced together.

The distal end of each forward leg may be rotatably mounted to the back bar or a remaining portion of the forward leg, whereby the handle and handle lever may be rotated with respect to the gripping members to allow a maximum degree of freedom for use of the tool available in a given construction site.

BRIEF DESCRIPTION OF THE DRAWINGS

The preferred embodiments of the invention are described in the several drawings, in which.

DETAILED DESCRIPTION OF THE INVENTION

The present invention will now be described more fully hereinafter with reference to the accompanying drawings, in which one or more preferred embodiments of the invention are shown. This invention may, however, be embodied in many different forms and should not be construed as limited to the embodiments set forth herein; rather, these embodiments are provided so that the disclosure will fully convey the scope of the invention to those skilled in the art. Like numbers refer to like elements throughout. The drawings are not necessarily drawn to scale but are configured to clearly illustrate the invention.

Figure 1:
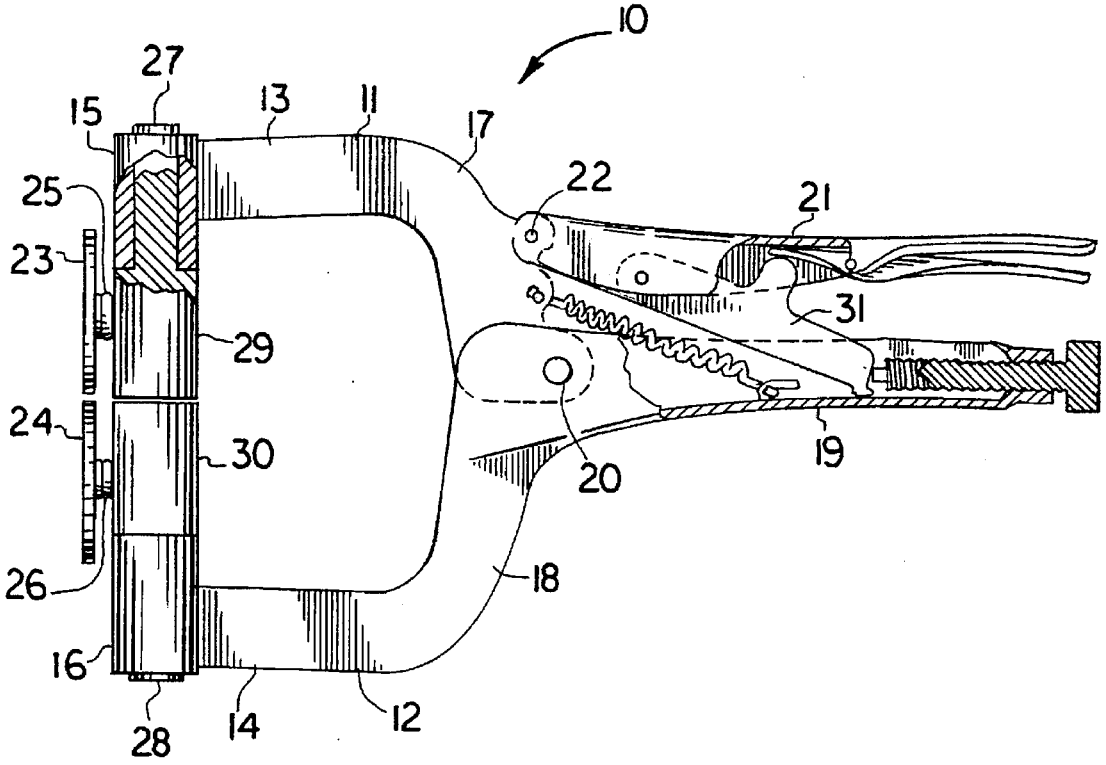
FIG. 1 is a view in side elevation of a tool constructed in accordance with the present invention.

A duct assembly tool 10 according to the invention is depicted in FIG. 1 Tool 10 is provided with "Vise Grip" type handles as are generally described in U.S. Pat. No. 2,641, 149, incorporated herein by reference. Tool 10 is further provided with a novel gripping means as will be described below in detail. Tool 10 is built from metallic components.

Tool 10 comprises first and second substantially C-shaped jaws, 12 and 11 respectively, which are disposed in a common plane with their open sides, at the distal ends of generally cylindrical-shaped members 30, 29, opposed to each other. Each jaw 12, 11 comprises a back bar 14, 13; forward legs 16–30, 15–29 and rear legs 18, 17 extend from the ends of the respective back bar 14, 13 to which they are mounted.

Handle 19 is rigidly fixed at its proximal end to the rear leg 18 of first jaw 12. A first pivot coupling 20 is provided between the distal end of the rear leg 17 of second jaw 11 and the proximal end of handle 19.

A second pivot coupling 22 is provided between the proximal end of handle lever 21 and rear leg 17 of second jaw 11 at a substantial distance along rear leg 17 from first pivot coupling 20. A toggle link coupling 31 is provided between handle 19 and handle lever 21 for locking jaws 12, 11 against separation when handle 19 and handle lever 21 are forced together.

Figure 4:
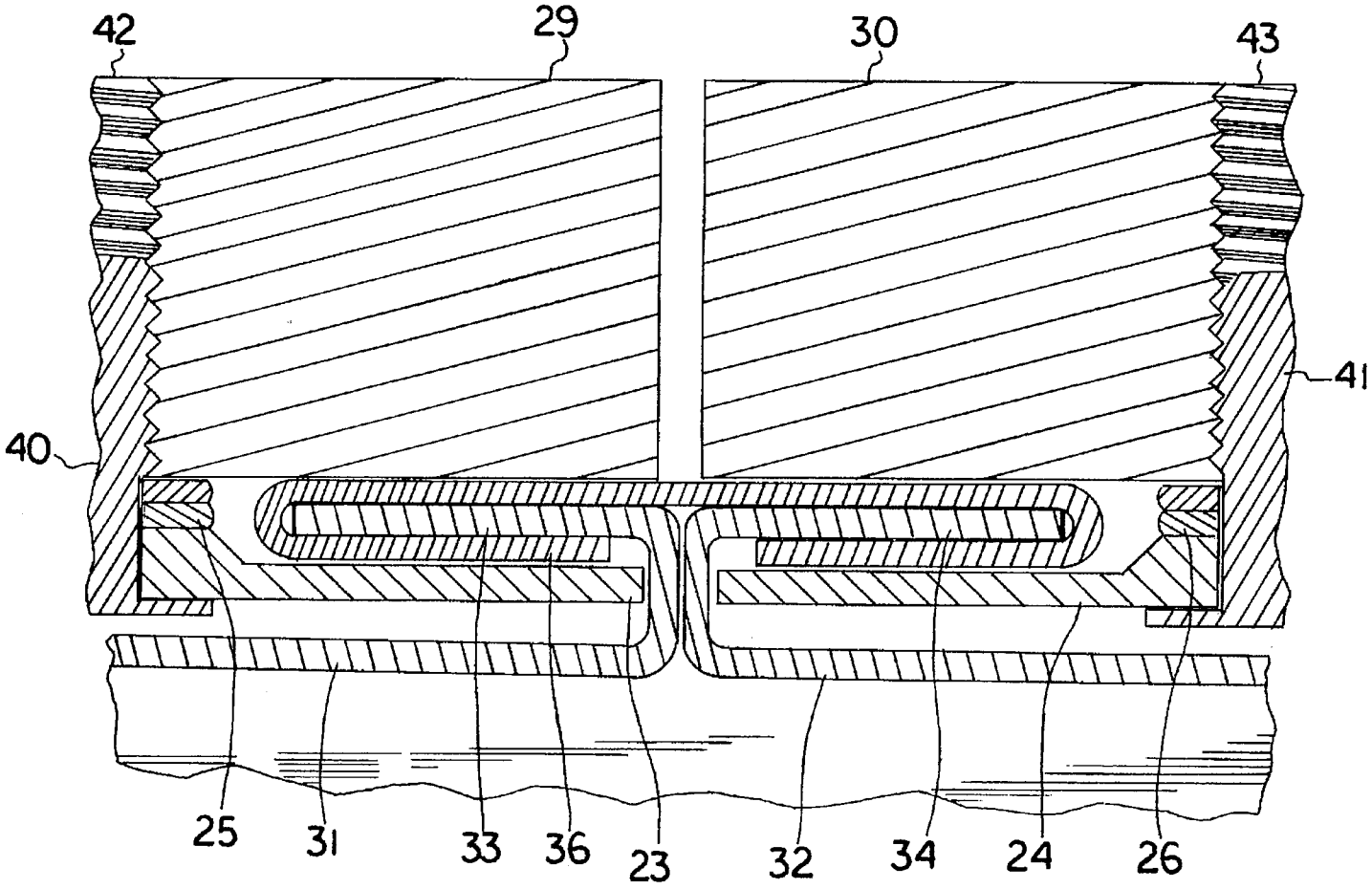
FIG. 4 is sectional view in side elevation of a cleat inserted between the gripping members and the jaw forward legs; and, FIG. 5 is an illustration of the manner in which the too may be applied to restore the shape of crumpled duct sections.
Figure 5:
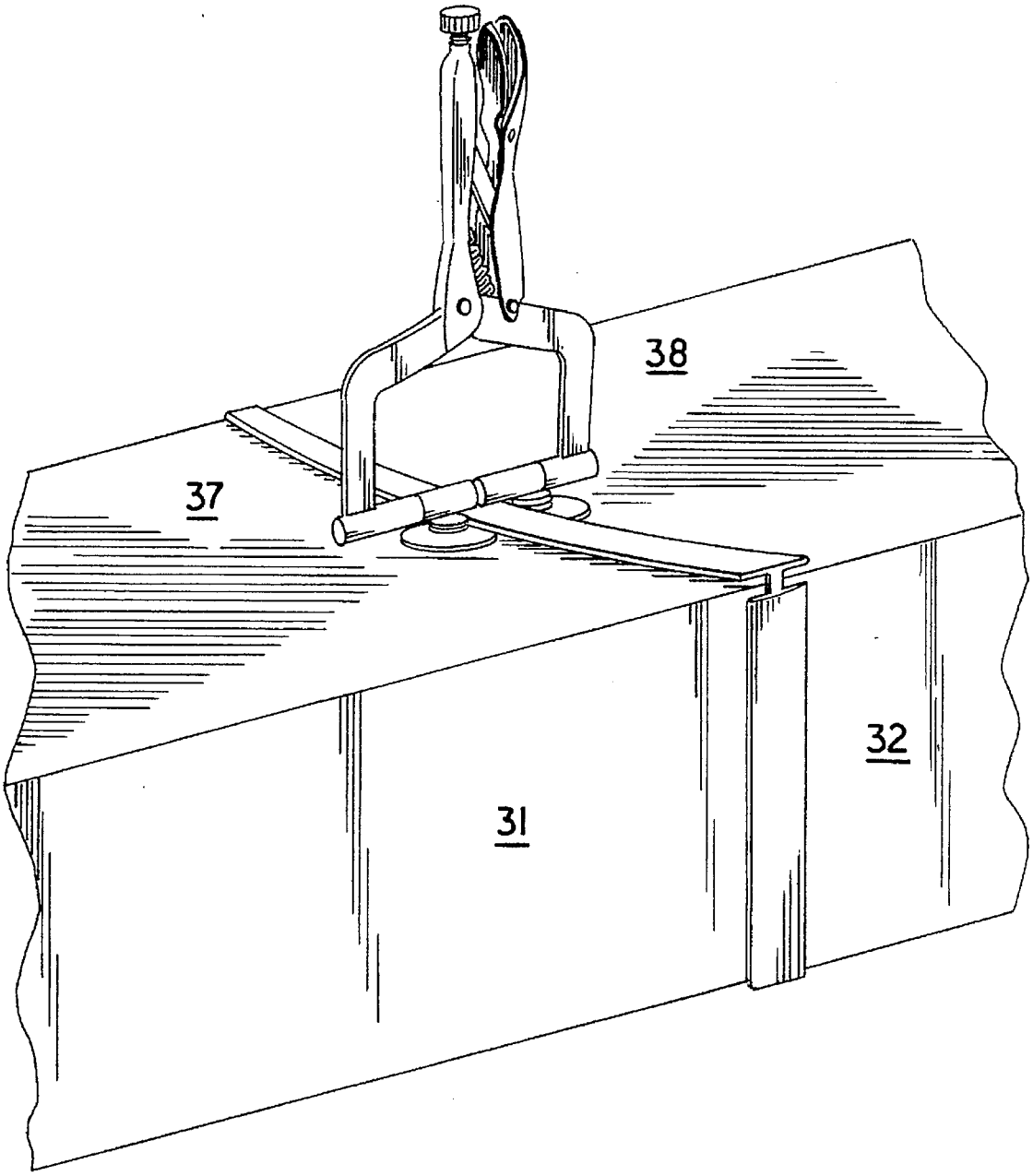

Referring to FIGS. 1, 4, and 5, the jaw forward legs each comprise a rigid tubular member 16, 15 fixedly mounted to its respective back bar 14, 13. At its distal end, each forward leg further comprises a generally cylindrical-shaped member 30, 29, respectively provided with a pin 28, 27 mounted thereto. Pins 28, 27 are respectively seated within the internal bore of tubular members 16, 15 and provided with respective tips 28, 27, each said tip enlarged so as to prevent the removal of member 30 from member 16 or the removal of member 29 from member 15. By this arrangement, member 30 is free to rotate with respect to member 16 and member 29 is free to rotate with respect to member 15.

Members 30, 29 are further provided respectively with disc-shaped rigid gripping members 24, 23. Gripping members 24, 23 are mounted respectively on externally threaded shafts 41, 40 which are seated respectively in internally threaded seats 43, 42 within members 30, 29 respectively. Of course, the gripping members may be mounted by welding or other suitable means as desired. Gripping members 24,23 are thus free to rotate with respect to handle 19 and handle lever 21. A pair of copper rings 26,25 are provided around each shaft 41,40 as shown in FIG. 4. Gripping members 24, 23 are mounted respectively to members 30,29 at a distance sufficient to enable a duct cleat 36 to be inserted between each gripping member and members 30,29.

Figure 2:
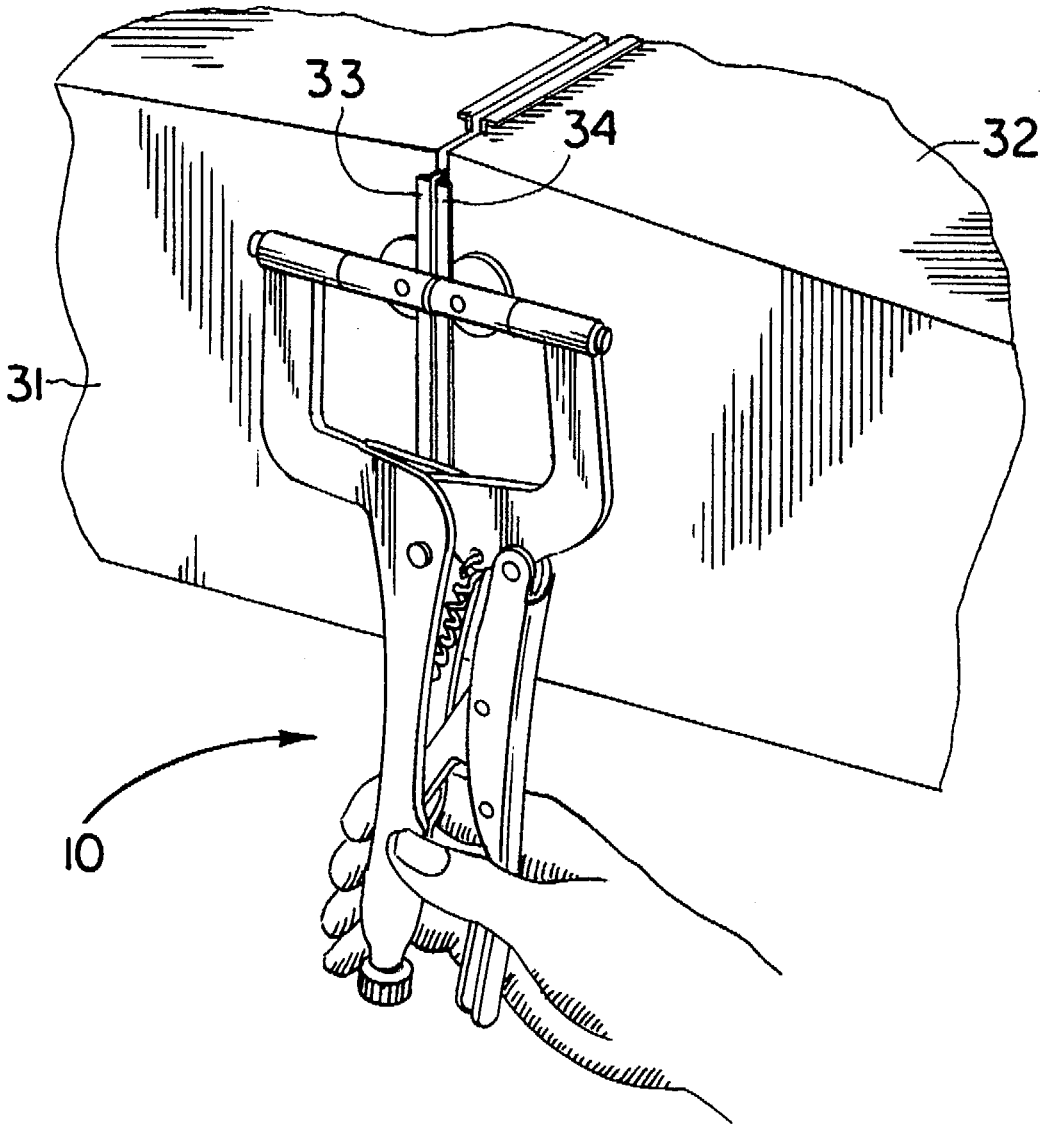
FIG. 2 is an illustration of the manner in which the tool is used to draw duct sections together.
Figure 3:
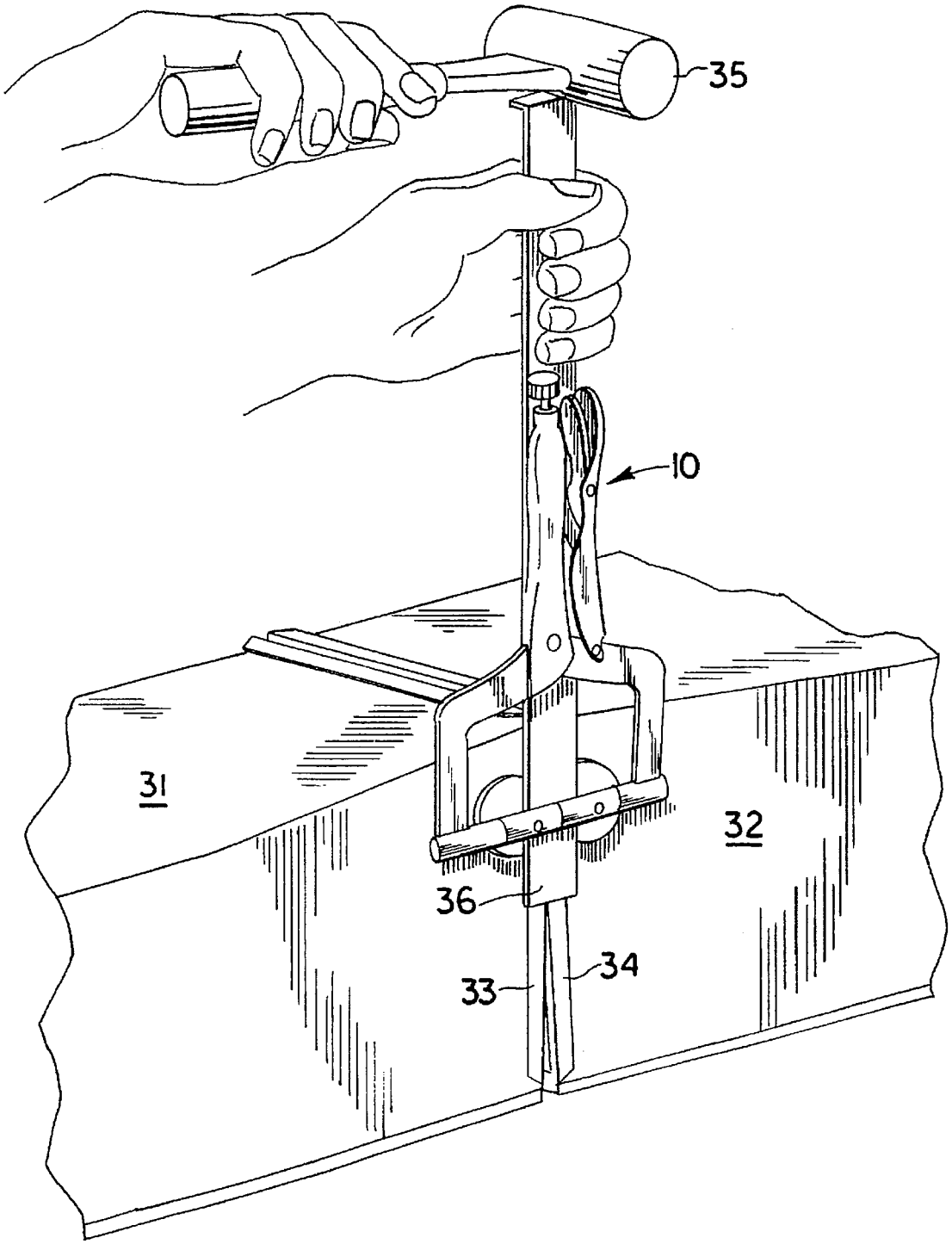
FIG. 3 is an illustration of the manner in which the tool may be released to allow both hands to drive a cleat.

Tool 10 can be used to assemble duct work in the manner shown in FIG. 2. Gripping members 24,23 are inserted so as to close assembly flanges 33,34 respectively of ducts 31,32. The mechanical advantage provided by tool 10 may be used to assist in closing gaps between ducts 31,32 by closing together handle 19 and handle lever 21.

After the handle and handle lever are closed and locked together, the assembler advantageously may completely release tool 10 to use both hands in driving cleat 36 over assembly flanges 33,34 with the use of hammer 35. Tool 10 may also advantageously be rotated to any position within the 180 degrees of freedom afforded by the sides of ducts 31,32 to utilize any space available at the job site.

As particularly shown in FIG. 4, when tool 10 is operated as above described, cleat 36 is fitted over assembly flanges 33,34, and can be driven between flanges 33,34 and gripping members 24,23. Sufficient distance is provided between gripping members 24,23 and members 30,29 to allow the insertion of cleat 36 in the space therebetween as shown.

Another advantageous use of tool 10 is illustrated in FIG. 5. Tool 10 may be used to effect repairs to duct walls 37,38 which have become bowed inward due to being walked on or for other reasons. Assembly of the ducts 31,32 may be impossible until the bowing is straightened. Configuration of tool 10 allows the assembler to couple the tool to the ducts as shown and pull in the upward direction as shown in FIG. 5 in order to straighten the bowing of walls 37,38.

It is to be understood that the invention is not limited to the exact details of the construction, operation, exact materials, or embodiments shown and described, as modifications and equivalents will be apparent to one skilled in the art without departing from the scope of the invention.

What is claimed is:

1. A duct assembly tool, comprising:

first and second substantially C-shaped jaws disposed in a common plane having opposed open sides, each jaw having a back bar and forward and rear legs extending from the back bar;

a handle having a proximal end rigidly fixed to the rear leg of the first jaw;

a first pivot coupling between the rear leg of the second jaw and the proximal end of said handle;

a handle lever;

a second pivot coupling between a proximal end of said handle lever and the rear leg of the second jaw at a location which is a substantial distance along the rear leg of the second jaw from the first pivot coupling;

a rigid gripping member mounted to a distal end of each of said forward legs at a distance from the forward leg to which it is mounted sufficient to enable a duct cleat to be inserted between said gripping member and the forward leg to which it is mounted in order to position said duct cleat over duct assembly flanges to secure two ducts to each other; and, a toggle link coupling between the handle and the handle lever for locking the jaws against separation when the handle and the handle lever are forced together.

2. A duct assembly tool as set out in claim 1, wherein each gripping member is disc-shaped.

3. A duct assembly tool as set out in claim 1, wherein a distal end of each forward leg is rotatably mounted to the back bar or a remaining portion of the forward leg, whereby the handle and handle lever may be rotated with respect to the gripping members.

4. A duct assembly tool, comprising:

a clamp operated with toggle action having first and second opposed jaws, each said jaw comprising a rigid gripping member mounted in substantially parallel relation to a forward leg by a shaft, the length of said shaft being sufficient to enable a duct cleat to be inserted between said gripping member and the forward leg to which it is mounted in order to position said duct cleat over duct assembly flanges to secure two ducts to each other.

5. A duct assembly tool as set out in claim 4, wherein each said rigid gripping member has a shape in the form of a disc.

* * * * *